US005080176A

United States Patent [19]

Polan et al.

[11] Patent Number: 5,080,176

[45] Date of Patent: Jan. 14, 1992

[54] DIRECTLY MOUNTED PENDENT-STYLE SPRINKLERS AND COVERS

[75] Inventors: George S. Polan, Harleysville; George Meyer, Malvern, both of Pa.

[73] Assignee: Central Sprinkler Corporation, Lansdale, Pa.

[21] Appl. No.: 624,813

[22] Filed: Dec. 10, 1990

Related U.S. Application Data

[63] Continuation-in-part of Ser. No. 356,740, May 25, 1989, Pat. No. 4,976,320, and a continuation-in-part of Ser. No. 535,927, Jun. 11, 1990.

[51] Int. Cl.[5] ..... A62C 37/08

[52] U.S. Cl. ..... 169/37; 169/42; 169/41

[58] Field of Search ..... 169/37, 40, 38, 39, 169/42, 90, 41

[56] References Cited

U.S. PATENT DOCUMENTS

| | | | |
|---|---|---|---|
| 3,393,746 | 7/1968 | Hodnett | 169/41 |
| 3,633,676 | 1/1972 | Gloeckler | 169/40 |
| 3,714,989 | 2/1973 | Gloeckler | 169/42 X |
| 3,727,695 | 4/1973 | Danton | 169/37 |
| 3,756,321 | 9/1973 | Gloeckler | 169/40 |
| 3,783,947 | 1/1974 | Dix et al. | 169/40 |
| 3,998,273 | 12/1976 | Juliano | 169/42 X |
| 4,014,388 | 3/1977 | Anderson | 169/42 X |
| 4,015,665 | 4/1977 | Simons et al. | 169/40 |
| 4,066,129 | 1/1978 | Anderson | 169/37 |
| 4,105,076 | 8/1978 | Simons et al. | 169/40 |
| 4,117,887 | 10/1978 | Anderson | 169/37 |
| 4,215,751 | 8/1980 | Mears | 169/37 X |
| 4,596,289 | 6/1986 | Johnson | 169/37 |
| 4,706,759 | 11/1987 | Grasseschi | 169/51 |
| 4,880,063 | 11/1989 | Leininger et al. | 169/37 |
| 4,926,946 | 5/1990 | Polan | 169/37 |

OTHER PUBLICATIONS

Viking Technical Data—Micromatic Model A Concealed Sprinkler, Jul. 31, 1989 (Sprinkler 23) (Sprinkler 24) 2 pages.

*Primary Examiner*—Joseph F. Peters, Jr.
*Assistant Examiner*—Christopher P. Ellis
*Attorney, Agent, or Firm*—Panitch Schwarze Jacobs & Nadel

[57] ABSTRACT

A sprinkler cover is provided including a ceiling member and a pair of identical bracket members which are soldered to the ceiling member for thermal release. Each of the bracket members includes one or more upright arms. Each arm includes one or more cut tabs which constitute a separate member to engage with a deflector on a conventional fixed frame or drop-type pendent or ceiling sprinkler or with an arm supporting such deflector from the sprinkler body. The tabs are spaced at various heights from the base of the ceiling member to permit the cover to be mounted at adjustable heights on the deflector or the arms of the sprinkler. Frame-type sprinklers may be modified by the provision of one or more complementary engagement structures on one or both arms to engage one or a plurality of the bracket tabs.

22 Claims, 5 Drawing Sheets

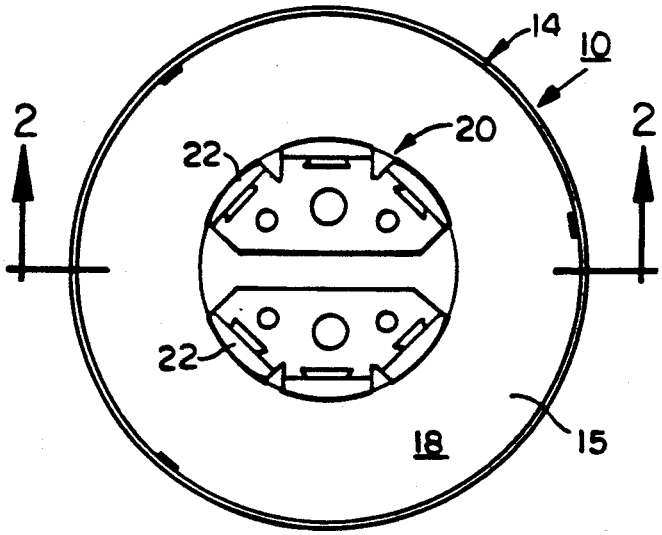
FIG. 1
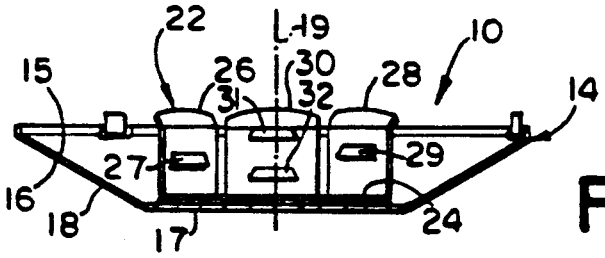
FIG. 2
FIG. 3
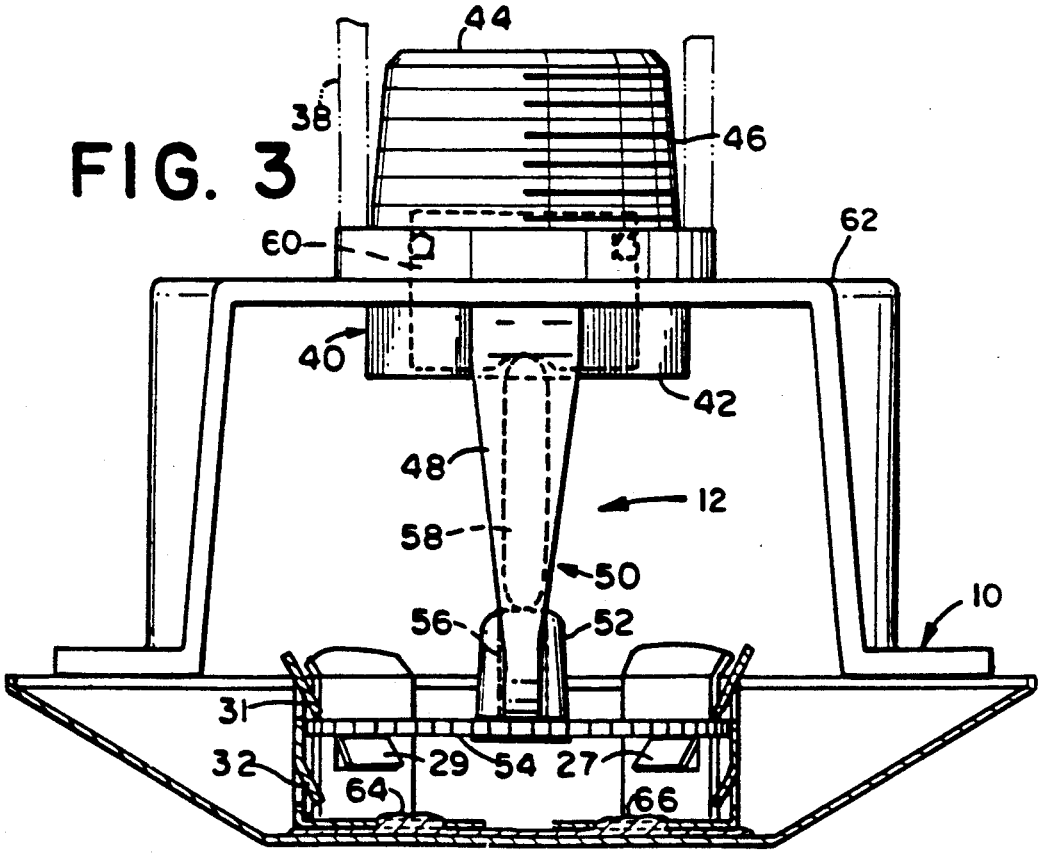

DIRECTLY MOUNTED PENDENT-STYLE SPRINKLERS AND COVERS

RELATED APPLICATION

This application is a continuation-in-part of U.S. application Ser. No. 07/356,740 filed May 25, 1989, issuing as U.S. Pat. No. 4,976,320 on Dec. 11, 1990, and U.S. application Ser. No. 07/535,927 filed June 11, 1990, which applications and patent are incorporated by reference in their entirety herein.

FIELD OF THE INVENTION

The invention relates to ceiling sprinklers and, in particular, to decorative covers adapted to directly mount to such sprinklers and to sprinklers adapted to directly receive and support such covers.

BACKGROUND OF THE INVENTION

Frame-type sprinklers are often installed extending downwardly through a ceiling from piping running above the ceiling. The piping supplies water or other fire-retarding fluid to the sprinkler.

Generally speaking, frame-type sprinklers include a frame having a pair of arms which are fixedly coupled with and extend away from a body of the sprinkler on either side of an outlet on the body. Ends of the arms remote from the sprinkler body are brought together at a joint or connect with a common cross member. The frame extends completely around the sprinkler outlet. Typically a temperature-sensitive element is biased against a plug positioned within the outlet by an adjustment screw extending through the joint or cross member. The joint or cross member further fixedly supports a water deflector spaced from the sprinkler outlet and typically protruding below the lower surface of the ceiling through which the sprinkler is installed to deflect water outwardly from the sprinkler at a level beneath the ceiling when the sprinkler activates.

Drop-type sprinklers are also installed through ceilings. In drop-type sprinklers, the fluid deflector plate is initially supported close to the sprinkler body at or above the ceiling line before the sprinkler is activated. The deflector drops from that position to a position below the ceiling line just before or at the same time as the activation of the sprinkler. The deflector is typically supported at the ends of guide pins or the like slidingly coupled with a flange portion of the sprinkler body or some other supporting structure also supported by the sprinkler body. The guide pins function like the fixed arms of the aforesaid frames in that they support the deflector in alignment with and spaced from the outlet.

Sprinklers are often installed in locations where aesthetics are a consideration, such as office buildings, schools, etc. To improve the appearance of such sprinklers, covers are preferred which hide the sprinkler and the ceiling opening while the sprinkler is not operating. During a fire, the cover must drop away from the sprinkler, at least by the time the sprinkler activates, so as not to interfere with the delivery of water or other fire-retarding fluid from the sprinkler body over the deflector.

One approach which has been widely used for securing a cover to a sprinkler so that the cover will disconnect from the sprinkler during the fire, has been to use temperature-sensitive seal means between a ceiling plate portion of the cover and a support or bracket member. This approach is shown, for example, in U.S. Pat. No(s). 3,393,746, 3,727,695, 3,998,273, and 4,215,751 disclosing frame-type sprinklers. It is also shown, for example, in U.S. Pat. No. 4,066,129 showing a drop-type sprinkler. In each instance, some ancillary structure, such as a housing, yoke, etc. formed on or coupled with the sprinkler body has been provided specifically to receive the ceiling cover. Two of the U.S. Pat. No(s). 3,393,746 and 4,215,751, disclose covers which are adapted to be adjustably positioned with respect to the sprinkler body and the deflector to compensate for the variations between the height of the sprinkler and the ceiling. Such variations typically arise during the installation of such sprinklers.

U.S. Pat. No. 4,926,946 discloses a drop-type ceiling sprinkler with cover in which one or more spring clips are wedged between the sprinkler body and the deflector. The clips engage and support a cover. When the sprinkler is activated, a plug valve assembly carrying the deflector drops from the sprinkler body, releasing the spring clips and dropping the cover.

Recently, a cover for frame-type sprinklers has been introduced which includes a generally circular ceiling plate having a pair of centrally located, opposing bracket members. Each bracket member is made from a metal alloy with heat-activated "memory". Each of the bracket members has a pair of spaced, upstanding, resilient arms, each arm has an upper edge turned inwardly towards the center of the cover. The inwardly turned edges can be snapped over a circular deflector supported on a frame-type sprinkler to support the cover directly from the deflector. When the cover is heated to a sufficiently high temperature, the memory of the alloy of the bracket members causes the bracket member arms to deflect radially outwardly, releasing the arms and cover from the deflector. The temperature-sensitive element used to trigger the activation of the sprinkler is then exposed to heat to which the cover was previously exposed.

A major advantage provided by the clip-retained cover of U.S. Pat. No. 4,926,946 and of this last-mentioned cover using "memory" alloy brackets is that, strictly speaking, neither requires any ancillary structure on the sprinkler, apart from the sprinkler body and the deflector, which are ordinarily provided. Each type of cover can be retroactively mounted to such sprinklers.

However, unlike the cover disclosed in U.S. Pat. No. 4,926,946, the memory alloy cover is not adjustable in height with respect to the sprinkler. The lack of an adjustment feature on the memory alloy cover places that cover at a distinct commercial disadvantage. Purchasers and potential purchasers are primarily interested in the provision of such covers for aesthetic reasons. Because it is impossible, or nearly impossible, to exactly position sprinklers with respect to the ceiling through which they extend, the memory alloy clip cover is likely to be noticeably spaced from the ceiling for a sprinkler installed lower than the maximum permitted height of the sprinkler.

SUMMARY OF THE INVENTION

In one aspect, the invention comprises a cover adapted for use with a sprinkler including a sprinkler body having a outlet on one side thereof through which a fire-retarding fluid flows when the sprinkler activates, a deflector and deflector support means including a pair of arms extending away from the one side of the body for supporting the deflector spaced from the body generally aligned with the outlet to deflect fire-retarding fluid flowing from the outlet generally outwardly around the sprinkler body. The cover comprises a ceiling member having a pair of opposing major sides. The cover further comprises bracket means projecting from one major side of the ceiling member, the bracket means being configured to receive at least the deflector of the sprinkler. The cover further comprises a plurality of discrete engagement means positioned along the bracket means at a plurality of different heights from the ceiling member for engaging at least one of the deflector and the deflector support means at any of a plurality of different distances of the ceiling member from the outlet whereby the cover member may be adjustably mounted to the sprinkler by direct coupling with the one of the deflector and the deflector support means.

In another aspect, the invention comprises a sprinkler adapted for directly receiving and supporting a ceiling cover including a ceiling member having a pair of opposing major sides, a bracket structure extending from one major side and a discrete engagement structure on the bracket structure. The sprinkler comprises a sprinkler body having an outlet on one side thereof through which a fire-retarding fluid flows when the sprinkler is activated. The sprinkler further comprises deflector means for deflecting the fire-retarding fluid flowing from the outlet generally outwardly about the sprinkler body. The sprinkler further comprises deflector support means including a pair of arms extending away from the one side of the sprinkler body towards the deflector means for supporting the deflector means on the one side of the body spaced from the sprinkler body generally aligned with the outlet. The sprinkler further comprises a plurality of discrete complementary engagement structures positioned along at least one of the arms at different distances from the outlet for contacting and engaging the engagement structure on the ceiling cover bracket structure when the cover is fitted over the deflector and onto the arms of the sprinkler.

In a third aspect, the invention comprises a cover adapted for use with a sprinkler including a sprinkler body having a outlet on one side thereof through which a fire-retarding fluid flows when the sprinkler activates, a deflector and deflector support means including a pair of arms extending away from the one side of the body for supporting the deflector spaced from the body generally aligned with the outlet to deflect fire-retarding fluid flowing from the outlet generally outwardly around the sprinkler body. The cover comprises a ceiling member having a pair of opposing major sides. The cover further comprises bracket means projecting from one major side of the ceiling member, the bracket means being configured for receiving at least the deflector of the sprinkler. The cover further comprises discrete engagement means on the bracket means for engaging at least one of the deflector and the deflector support means whereby the cover is adjustably mountable to the sprinkler by direct coupling with one of the deflector and the deflector support means. The cover further comprises thermal release means for releasably joining at least a portion of the bracket means to the ceiling member, the thermal release means releasing at least the portion of the bracket from the ceiling member at a temperature above ambient room temperature and below about 200° F., thereby permitting the cover to fall away from the sprinkler.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings:

FIG. 1 is a diagrammatic top plan view of a first preferred cover of the present invention;

FIG. 2 is a diagrammatic sectioned side elevation of the cover taken along the lines 2—2 of FIG. 1;

FIG. 3 is a diagrammatic, sectioned side elevation of the cover of FIGS. 1 and 2 mounted to the fixed deflector of a frame-type, ceiling sprinkler;

DESCRIPTION OF PREFERRED EMBODIMENTS

Figure 5:
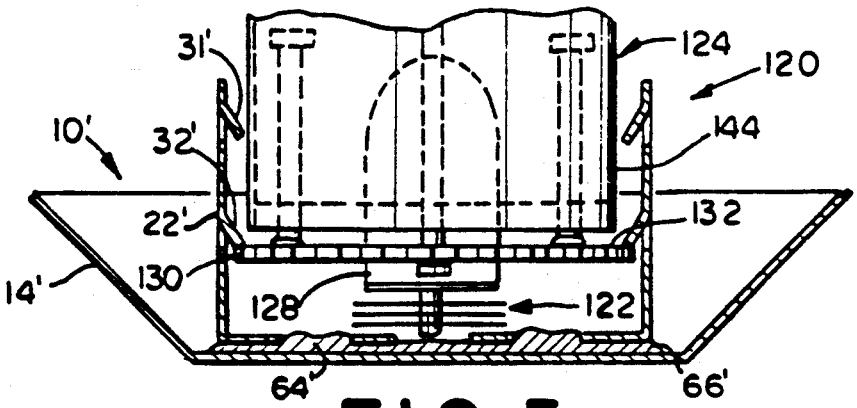
FIG. 5 is a diagrammatic, sectioned side elevation of the cover of FIGS. 1 and 2 mounted to the deflector of a second drop-type ceiling sprinkler.

Referring to the drawings, like numerals are employed for the indication of the same elements throughout.

There is shown in FIGS. 1—3 a first preferred embodiment cover, indicated generally at 10. Cover 10 is intended for use with a frame-type pendent or ceiling sprinkler, indicated generally at 12 in FIGS. 1—3.

Referring to FIGS. 1 and 2, the cover 10 includes a ceiling plate or ceiling member 14. Preferably, the ceiling member 14 is generally frustoconical in shape with two opposing major sides 15 and 16. A generally concave side 15 faces the sprinkler to which the cover 10 is mounted, while a generally convex side 16 faces away from the sprinkler 12 and is seen when the cover 10 is mounted to a sprinkler. Preferably, the ceiling member 14 includes a central circular planar portion 17 and an annular conical portion 18 extending around the planar portion 17. Both portions 17 and 18, the ceiling member 14 and cover 10 are all concentric about a common central axis 19.

Projecting transversely from the concave side 15 of the cover member 14 are bracket means or bracket structure, indicated generally at 20. Preferably, the bracket means or structure 20 is provided by two identical bracket members, each indicated by the reference numeral 22. Referring to FIG. 2, preferably each bracket member 22 includes a base 24 and a plurality of arms, in this case three arms 26, 28 and 30 extending transversely, preferably generally perpendicularly, to the base 24. Each of the two outer arms 26 and 28 is cut to form an inwardly deflected tab 27 and 29, respectively. The central arm 30 has been cut twice to form two inwardly deflected tabs 31 and 32. The tabs 27, 29, 31 and 32 are spaced at different heights along the bracket arms 26, 28 and 30 from the base 24 of the bracket member 22 and the adjoining central circular planar area 17 of the ceiling member 14 to which the bracket members 22 are mounted.

FIG. 3 depicts a conventional, frame-type, ceiling sprinkler, indicated generally at 12, with which the cover 10 can be used. Sprinkler 12 includes a hollow sprinkler body 40 having a outlet indicated generally at 42 on one side thereof through which a fire-retarding fluid flows when the sprinkler 12 activates. An inlet, indicated generally at 44, is provided on an opposite side of the body 40. The inlet end of the sprinkler body 40 is further provided with threading 46 adapting the body for coupling that inlet end of the sprinkler body 40 into a fire-retarding fluid feed pipe or drop nipple, indicated in phantom at 38. Fixedly extending away from the outlet side of the sprinkler body 40 are a pair of spaced arms, one of which is seen in FIG. 3 at 48. The arms 48 form part of a frame, indicated generally at 50, extending from body 40 and surrounding the outlet 42. The arms 48 come together at an enlarged, centrally located knuckle 52. Knuckle 52 together with arms 48 fixedly and immovably support a fire-retarding fluid deflector 54 spaced from the body 40 generally aligned with the outlet 42. Deflector 54 is provided to deflect fire-retarding fluid flowing from outlet 42 generally outwardly around the sprinkler including the sprinkler body and the deflector. Knuckle 52 further receives an adjustment screw 56, indicated in phantom, which is used to adjust the load applied to a temperature sensitive means 58, also indicated in phantom. The temperature sensitive means 58 holds a plug 60, indicated diagrammatically in phantom, in the outlet 42 of the sprinkler body 40, sealing the sprinkler 12 before activation and use. The temperature sensitive seal means 58 is preferably a glass ampule containing an alcohol-base liquid which causes the ampule to fracture when heated to a sufficiently high temperature. Alternatively, the temperature sensitive means 58 could be a generally rigid member made of a material which softens or melts when heated to a sufficiently high temperature. The temperature-sensitive means 58 fractures or softens sufficiently to release the plug 60 at a temperature at least above ambient room temperature and about 200° F. or less, preferably between about 160° and 200° F. (about 70° and 93° C.). If desired, an optional gauge bracket, indicated generally at 62, can be provided on the sprinkler body 40 to assure that the sprinkler 12 is installed into a ceiling (not depicted) at a height sufficiently low that the ceiling does not interfere with the flow of fire-retarding fluid deflected outwardly about the sprinkler body by the deflector 54. It further serves to protect the outlet end of the sprinkler 12, including the temperature sensitive means 58 and deflector 54, when the sprinkler 12 is being mounted to the fire-retarding fluid feed pipe (not depicted) and after installation.

As is best seen in FIG. 3, the tabs 27, 29, 31 and 32 of each of the two bracket members 22 constitute a plurality of discrete deflector engagement means which are positioned along each bracket member 22 at different heights from the ceiling member 14, more particularly from the central circular portion 17, which constitutes a common reference to both bracket members 22. The tabs 27, 29, 31 and 32 are provided for engaging the deflector 54 at any of a plurality of different distances of the deflector 54 and, because of the rigid deflector mounting of the outlet 42, from the cover 10, more particularly, from the central circular planar area 17 of the ceiling member 14. .This permits the cover 10 to be adjustably mounted to the sprinkler 12 on deflector 54. Preferably about one-quarter inch or more of total adjustment is provided between the most widely spaced tab members 31 and 32.

To receive the deflector 54, the two bracket members 22 are spaced from one another around the center of the ceiling member 14, the center being indicated by central axis 19 in FIG. 2. More particularly, the bracket members 22 are preferably diametrically positioned on opposite sides of the center of the cover member 14. Arms 26, 28 and 30 are all generally tangentially located with respect to the generally circular deflector 54 when the deflector 54 is positioned between the brackets 22 and concentrically located with respect to the center of the cover member 14. Preferably, at least the arms 26, 28 and 30 of the bracket members 22 are resiliently flexible and the upper end of each bracket arm 26, 28 and 30 is deflected radially outwardly from axis 19 to permit the arms to be cammed radially outwardly by and to ride over the circumferential edge of the deflector 54 thereby receiving the deflector 54. The use of identical bracket members 22 reduces cost. The use of a pair of diametrically opposed bracket members, spaced from one another, permits the arms 48 of a frame style sprinkler, like sprinkler 12, to be located in the spaces between the bracket members 22, if necessary.

Preferably, the ceiling member 14 and bracket members 22 are made from a metal having a very high coefficient of thermal conductivity, like copper. Each of the bracket members 22 is releasably joined with thermal release means, preferably solder, to the ceiling member 14. Solder joints fixing each of the two bracket members 22 to the ceiling member 14 are indicated at 64 and 66, respectively, in FIG. 3. The metallic ceiling member 14 conducts heat to the solder joints 64 and 66 for releasing at least one and, preferably, both bracket members 22 from the ceiling member 14 when the cover 10 is heated. Preferably, the solder of joints 64 and 66 is any conventional, known, low-temperature composition, available from any of a variety of commercial sources, such as, for example, The Indium Corp. of America, Utica, N.Y., which will melt at a temperature of between about 117° and 135° F. (about 47° and 57° C.). This is a temperature above any ambient room temperature to which the sprinkler and cover would be exposed and below any envisioned minimum activation temperature of the sprinkler 12. Typically, residential/commercial sprinklers are rated for activation at temperatures between about 160° and 200° F. (about 70° and 93° C.).

Use of the cover 10 is straightforward. After the sprinkler 12 is installed in a conventional manner, the cover 10 is centered against the deflector 54 with the deflector 54 generally between the arms of the bracket members 22. The cover 10 is pressed towards the sprinkler 12 and onto the deflector 54 until the ceiling member 14 strikes the ceiling or until the deflector 54 or lowermost portion of knuckle 52 contacts the central circular area 17 of the ceiling member 14.

During a fire, heat is conducted by the ceiling member 14 to the solder of joints 64 and 66, melting the solder and releasing the ceiling member 14 and the bracket members 22 from one another. The temperature sensitive element 58 is then directly exposed to the heat. When the temperature sensitive element 58 is sufficiently heated, it melts or ruptures releasing the plug 60, which the element 58 held in the sprinkler body outlet 42, thereby activating the sprinkler. The bracket members 22 may fall away from the deflector 56 when the ceiling member 14 separates. If not, the bracket members 22 may be shaken from the deflector 54 when the released plug strikes the frame 50 and/or when the fire-retarding fluid strikes the deflector 54 or the bracket members 22 themselves.

Figure 4:
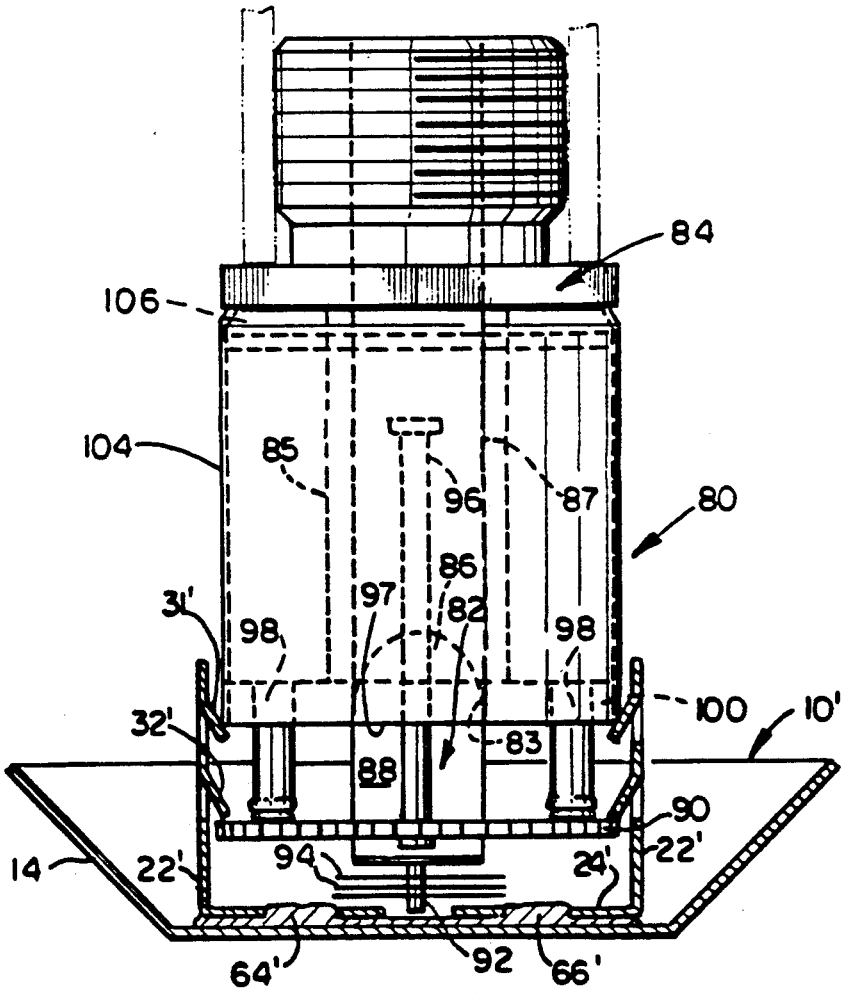
FIG. 4 is a diagrammatic, sectioned side elevation of the cover of FIGS. 1 and 2 mounted to the deflector of a first drop-type, ceiling sprinkler.

FIGS. 4 and 5 depict a modified cover 10 of the present invention used with conventional, drop-type ceiling sprinklers. Such sprinklers are disclosed and described in detail, for example, in U.S. Pat. No(s). 4,491,182 and 4,926,946, both of which are incorporated by reference herein in their entirety. Preferably the particular drop-type sprinklers disclosed in each of these two references are modified as will be explained to be better adapted to receive a cover of the present invention.

Referring first to FIG. 4, a first modified, drop-type sprinkler, indicated generally at 80, includes a plug valve assembly, indicated generally at 82, and a sprinkler body indicated generally at 84. The assembly 82 includes a plug 86, indicated in phantom, which is received in an outlet, indicated in phantom at 83, of an internal passage, indicated in phantom at 87, of a tubular portion 85 (also in phantom) of the sprinkler body 84. An elongated tubular stem 88 extending from the plug 86 supports a generally circular deflector 90. The interior of the lower end of stem 88 defines a chamber containing a temperature-sensitive element (neither depicted). The melting of the temperature-sensitive element releases the plug 86 from the outlet and activates the sprinkler 80. One or more heat-absorbing fins 94 can be mounted to the lower end of the stem 88 to collect and transfer heat through fin support member 92 to the internal chamber to improve the response time of the sprinkler 8.

Before the sprinkler 80 is activated, the plug 86 supports the assembly 82 from the sprinkler body 84. After activation of the sprinkler 80 by release of the plug 86, the assembly 82 is suspended beneath the outlet 83, spaced from the sprinkler body 84 generally aligned with the outlet 83 by a diametrically opposing pair of pins 96, one of which is seen in FIG. 4. If desired, compression springs (not depicted) can be provided in tubes 98 to bias the deflector 90 and assembly 82 away from the outlet 83 of the sprinkler body 84. Conveniently, the tubes 98 are fixed in and the pins 96 slip through a flange portion 100 (in phantom) of the sprinkler body 84. An optional tubular cover 104 extends between flange portion 100 and another flange portion 106 at an inlet end of the body 84, surrounding and protecting pins 96 and tubes 98.

Sprinkler 80 differs from the sprinklers disclosed in U.S. Pat. No(s). 4,491,182 and 4,926,946 in that the deflector 90 is spaced sufficiently far from the proximal portion of the sprinkler body, namely flange portion 100, so that the arms of brackets 22' of cover 10' can deflect inwardly over the circumferential edge of the deflector 90 to engage either of the tabs 31' and 32' with the deflector 90. Brackets 22' in FIGS. 4 and 5 are shown having a single arm supporting a pair of spaced tabs 31' and 32' for simplicity and clarity. Preferred brackets would include at least three arms and four spaced tabs, like the brackets 22 of FIGS. 1—3. Brackets 22, differ from brackets 22 primarily in the greater spacing of the tabs 31' and 32' from their bases 24' to accommodate the portion of assembly 82 below deflector 90. Brackets 22' are again thermally releasably secured to a ceiling plate 14' by solder joints 64' and 66'.

FIG. 5 depicts a second, alternate drop-type ceiling sprinkler, indicated generally at 120, for mounting a cover 10' of the present invention. The second, drop-type, pendent-style sprinkler 120 includes a deflector 130 of a diameter sufficiently greater than the diameter of the proximal portion of the body 124 of the sprinkler 120, for example, as defined by a cover 144 on the body 124, to provide a protruding circumferential edge 132 upon which the tabs 31' and 32' can engage. The sprinkler 120 may then employ a stem 128 of conventional length in its plug valve assembly 122, positioning the deflector 130 immediately adjoining the sprinkler body 124, as indicated in the Figure.

Figure 6:
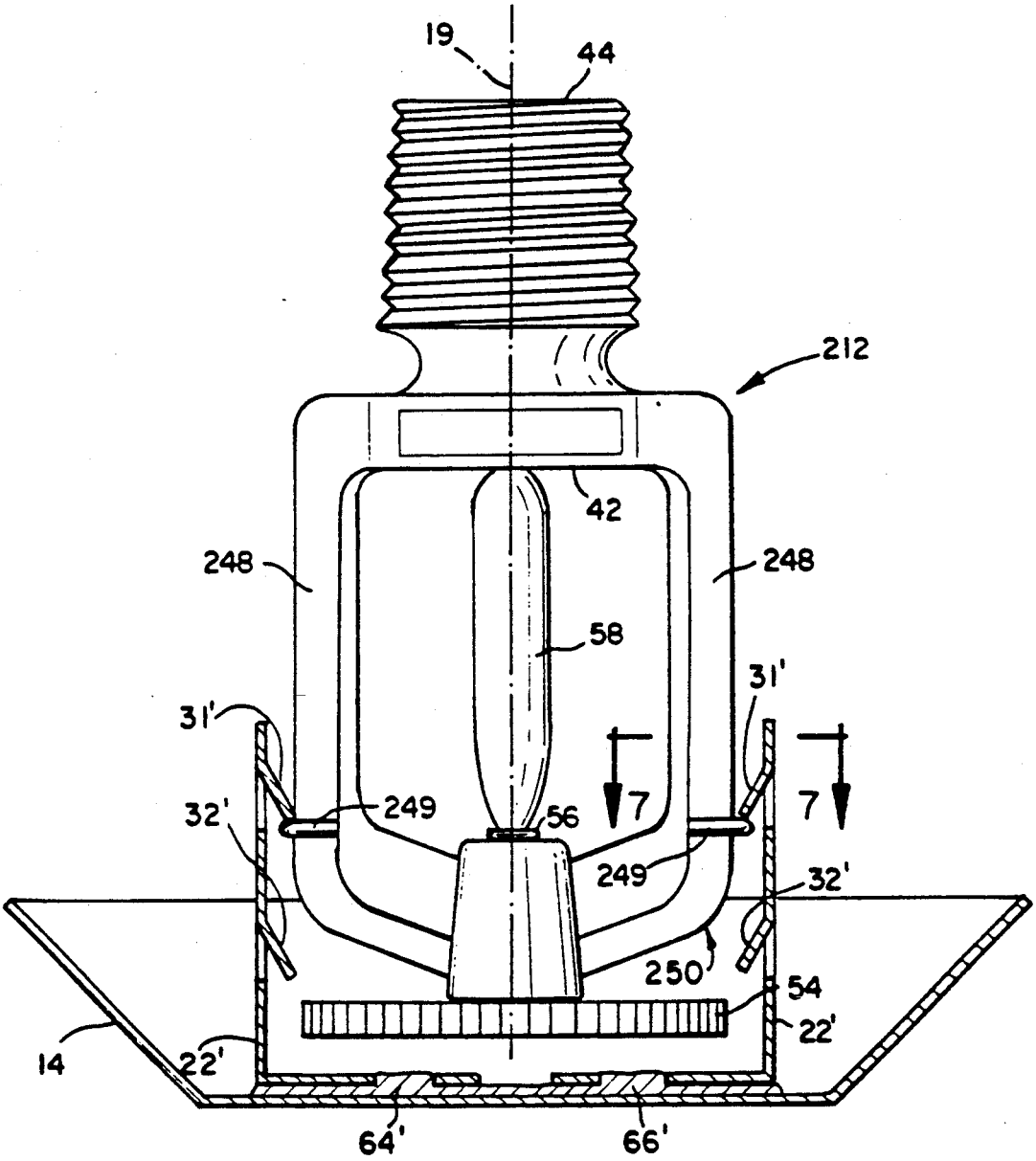
FIG. 6 is a diagrammatic, sectioned side elevation of a slightly modified cover of the present invention mounted to a second modified, frame-type sprinkler of the present invention.
Figure 8:
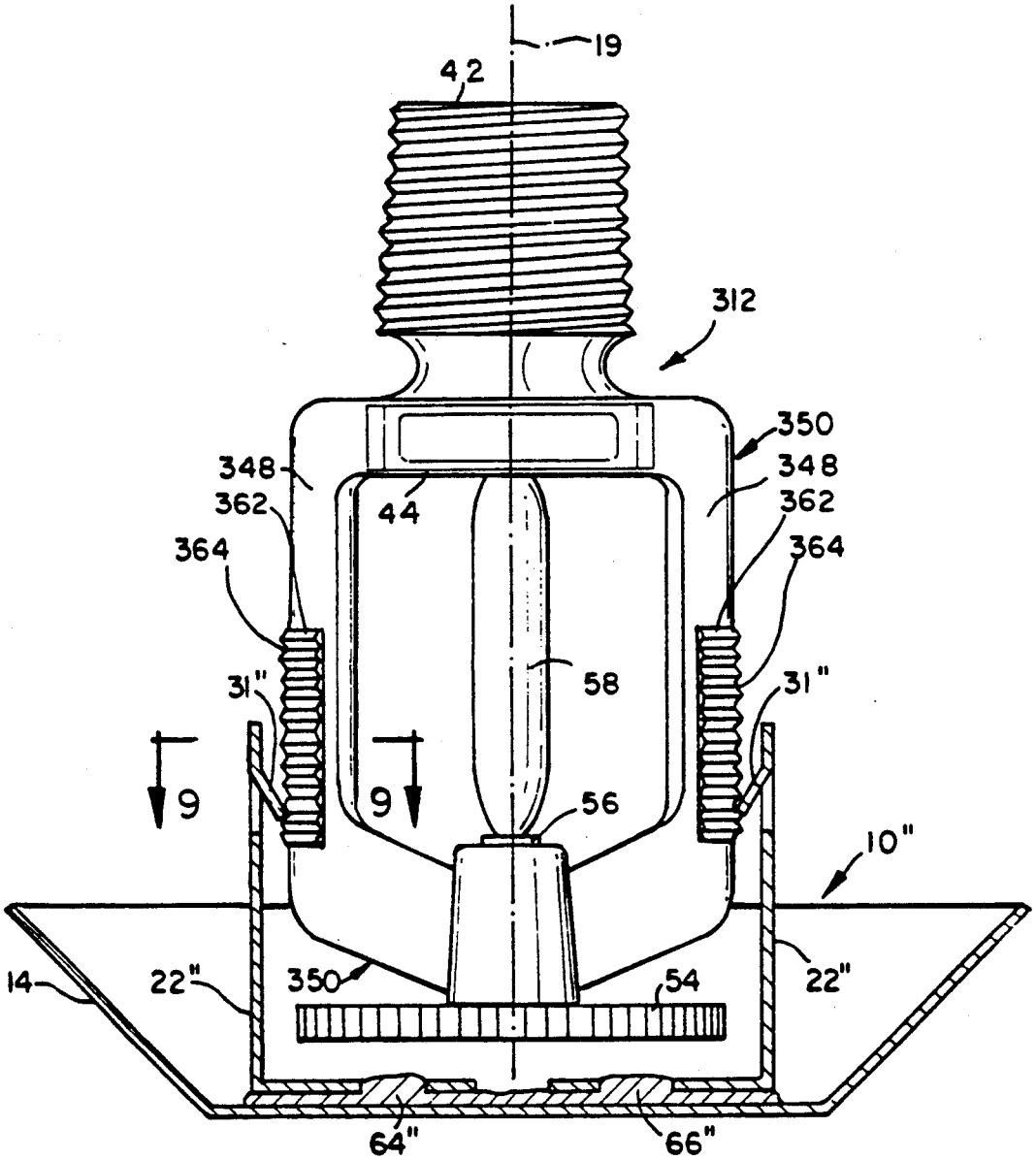
FIG. 8 is a diagrammatic side elevation of a third modified frame-type sprinkler embodiment of the present invention mounting a modified cover.

FIGS. 6 and 8 depict diagrammatically second and third modified, frame-type sprinklers indicated generally at 212 and 312, respectively. Sprinklers 212 and 312 can be identical to the frame-type sprinkler 12 of FIG. 3 or any other conventional, frame-type sprinkler except for the provision of one or more discrete engagement means on one or both arms of such sprinkler.

Figure 7:
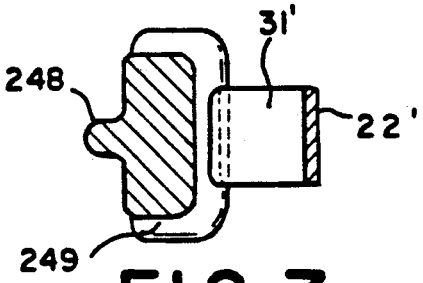
FIG. 7 is a diagrammatic, plan cross section taken along the lines 7—7 of FIG. 6 through an arm of the second modified, frame-type sprinkler and the bracket.

Referring first to FIG. 6, sprinkler 212 is identical to frame-type sprinkler 12 of FIG. 3 except that each of the arms, indicated at 248, of a frame means, indicated generally at 250, includes a discrete, complementary engagement means, preferably in the form of a ridge 249 projecting generally radially outwardly with respect to a central axis 19 of the sprinkler 212 on an outer surface of at least one and, preferably, both arms 248. The discrete, complementary engagement ridge 249 is positioned along the arms 248 for contacting and engaging one of the plurality of tabs which are provided on a cover, such as one of tabs 31' or 32' on cover 10' of FIG. 4, for example, when the tab(s) 31' or 31' and 32' of that cover are cammed over the ridge 249. Cover 10' includes bracket members 22' of a sufficient height to extend beyond the deflector 54, over the end of the frame 250 proximal the deflector 54 and onto the arms 248 whereby at least one of the plurality of discrete engagement tabs 31' and 32' interferingly engages ridge 249, thereby supporting the cover 10' directly from the arms 248 and sprinkler body 212. FIG. 7 depicts the coupling between a top one of the tabs 31' and the ridge 249. While a ridge 249 is preferred, any engagement structure on the arms 248 which complementarily engages the tabs 31' or 32' or any other engagement means provided on the cover can be used. For example, a groove can be substituted for ridge 249 with tabs 31' and 32'.

FIG. 8 depicts the third, modified, frame-type sprinkler, indicated generally at 312, of the present invention adapted for direct coupling with a complementarily configured cover 10''. Sprinkler 312 differs from conventional embodiment 12 and the second, modified embodiment 212 only in the treatment of its fixed frame arms 348 of its frame means 350, in particular, by the preferred provision of complementary engagement means in the form of "pads" or "lands" indicated at 362 on each of the arms 348.

Figure 9:
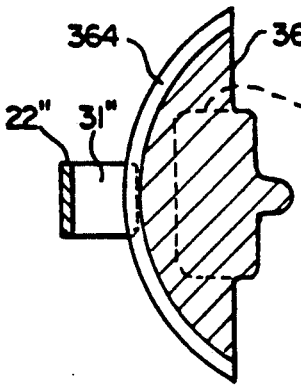
FIG. 9 is a diagrammatic, plan cross section taken along the lines 9—9 in FIG. 8 through an arm of the third modified, frame-type sprinkler and the bracket.

Referring to FIG. 9, a cross section through one of the arms 348 and pads 362, it can be seen that each pad 362 constitutes a built-up region on each arm 348, extending radially and circumferentially beyond the perimeter of the arm 348 adjoining each pad 362. The cross-sectional configuration of the arm 348 adjoining the pad 362 being indicated in phantom. The maximum transverse cross-sectional dimension of the sprinkler 312, perpendicular to the central axis 19 of the sprinkler, is greater than the corresponding dimension of the sprinkler 312 through the deflector 54. This permits a cover, such as cover 10' of FIG. 4, or a modified cover 10'' to be slipped onto the deflector 54 and the proximal portion of the frame means 350 adjoining the deflector 54. The bracket means 22' of cover 10' or 22'' of the cover 10'' should be sufficiently long that at least the uppermost one of the discrete engagement tabs 31' or 31'' on such cover 10' or 10'' can ride over and onto each of the pads 362. Preferably, each of the pads 362 extends no lower than the top of the adjustable load screw 56 so as not to interfere with the deflection of water by the lower portion of the frame means 350 or the deflector 54.

Each land 362 is provided with at least one and, preferably, a plurality of discrete engagement structures, indicated generally at 364, which are positioned along each of the pads 362 at different distances from the outlet 342 and deflector 54. The structures 364 are complementary to each of the discrete engagement means or structures 31', 31'' or 32' provided on the bracket on the cover 10' or 10'' mounted to the sprinkler 312 for contacting and engaging such bracket engagement structure(s) when such cover is fitted over the deflector 54 and onto the arms 348 and pads 362 of the sprinkler 310. The discrete engagement structures 364 provided on the pads 362 may be, for example, grooves provided in an otherwise uniform surface parallel with central axis 19, ridges protruding from such an otherwise uniform surface or a saw-toothed or sinusoidal surface having no portion parallel to the central axis 19.

The pads 362 preferably are provided by casting with the remainder of the frame means 350, as is conventional in most frame sprinklers, so as to be integrally and monolithically formed on the arms. The discrete engagement structures 364 on the pads 362 can either be formed during the creation of the pads or thereafter by conventional finishing techniques such as machining.

In addition to monolithic formation with the rest of the frame means, the pads 362 may also be provided as separate structures and thereafter applied or attached to the arms. The pads 362 conceivably can be attached to the arms 348 by means appropriate for the materials involved including adhesives, cements, braising or even solders. Conceivably, pads may be provided as separate, unattached structures which are held in compression against the arms 348 by the brackets of the cover, the pads frictionally coupling with the arms 348. While it is suggested that the pads 348 be of a metallic material, separately formed and applied pads could be of any suitable material, including nonmetallic material. Moreover, although a pair of pads are depicted, it is conceivable that only one pad 362 or its equivalent can be provided for supporting the cover with an opposing side of the cover bracket structure simply being held in compression against the remaining arm 348 of the frame which does not bear a pad 362 or its equivalent. In addition to being used with covers like cover 10'' with multiple discrete engagement structures on the brackets thereof, pads 362 of the type depicted, having a plurality of discrete engagement structures 364, permit adjustable mounting of covers having brackets with only one discrete engagement structure or member. The bracket arm must be sufficiently long to position to the uppermost one of the discrete engagement structures above the lowermost one and preferably as high as the uppermost one of the complementary engagement structures 364 on the pad or pads 362 when the cover 10'' bottoms out against the lower portion (i.e. deflector end) of the sprinkler 312.

Figure 10:
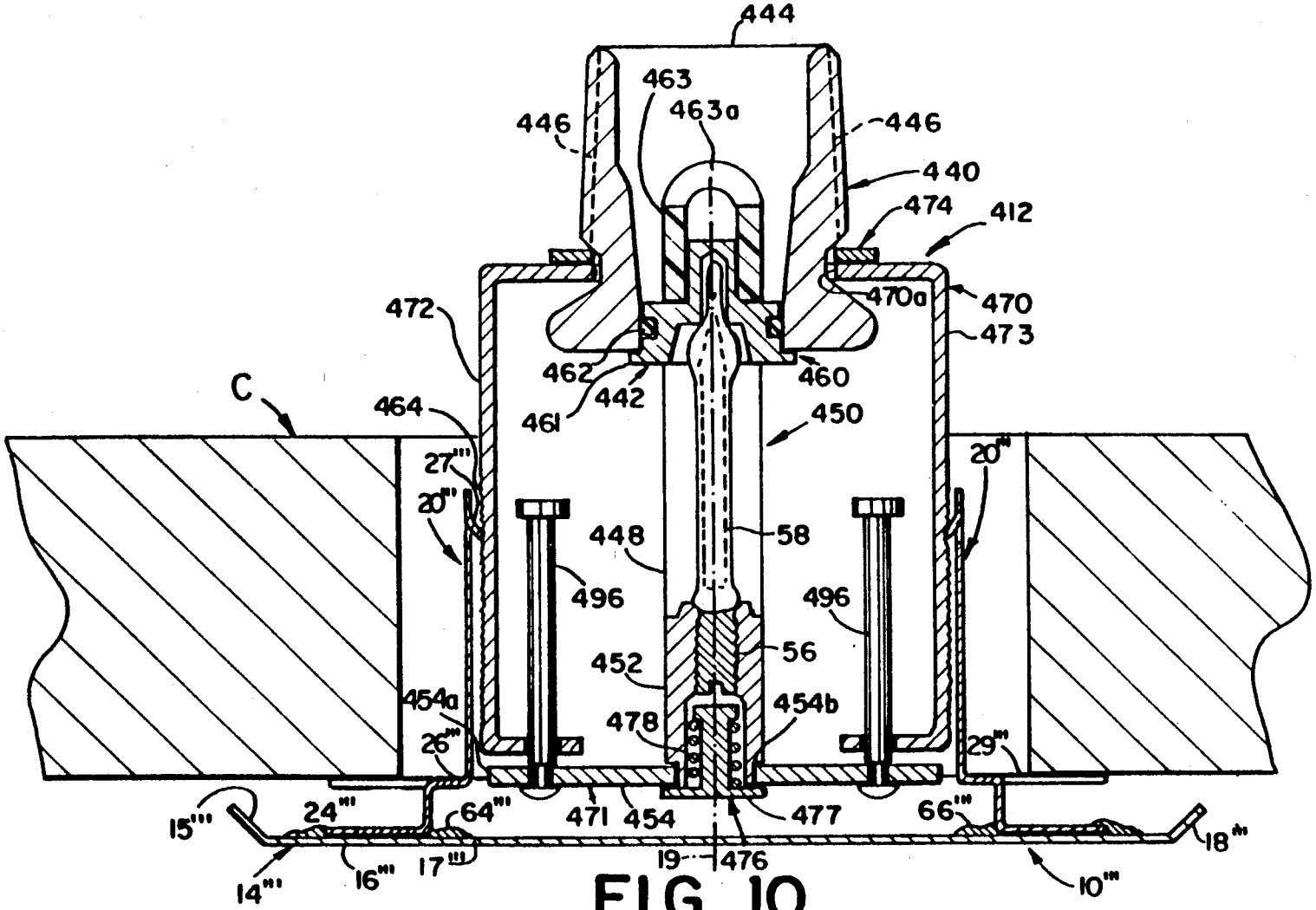
FIG. 10 is a diagrammatic, sectioned side elevation of yet another modified cover on a frame-type sprinkler provided with non-load-bearing arms supporting a drop-down deflector assembly.

FIG. 10 depicts yet another, modified, frame-type sprinkler, indicated generally at 412, of the present invention adapted for coupling with a complementary configured cover, indicated at 10''' through a "tuning fork", indicated generally at 470, supporting a drop-down deflector assembly, indicated generally at 471. The sprinkler 412 is conventional, including a sprinkler body, indicated generally at 440, having an outlet 442 and inlet 444 at opposing ends thereof and a hollow interior defining a fire-retarding fluid passageway between the inlet and outlet. Threading is indicated by broken lines 446 around the exterior of the sprinkler body 440 adjoining the inlet 444 for mounting the sprinkler body to a drop nipple, as has been indicated previously with respect to the other sprinkler body embodiments. Integrally and, preferably, monolithically formed with the sprinkler body 440 is a frame, indicated generally at 450, including a pair of mirror-image arms, one of which is depicted at 448, which extend from the body 440 on diametrically opposing sides of the outlet 442 into a knuckle, indicated at 452. Again, the knuckle has an upper threaded bore receiving an adjustment screw 56 which adjustably loads a temperature-sensitive means, indicated at 58, against a plug, indicated generally at 460, in the outlet 442. The plug 460 may be an assembly of components including an axially symmetric plug body, indicated at 461, configured to seat against the sprinkler body 440 at the outlet 442, suitable means such as an O-ring 462 for sealing the plug body 461 with the sprinkler body 440. The plug 460 may also include means indicated at 463 on the plug body 461 for causing the plug 460 to tumble when it is released from the outlet 442 by the temperature-sensitive means/element 58. The tumbling-inducing means 463 may be, for example, a Teflon TM tube press-fitted over a cylindrical end of the plug body 461 which faces into the sprinkler body 440, the tube 463 including an end surface **463*a* beveled with respect to a common central axis 19 of the sprinkler body 440, plug 460 and cover 10''' which axis is indicated at 19. The sprinkler 412 differs from the frame sprinkler 12 of FIG. 3 only in the absence of a gauge bracket 62 and in the mounting of a deflector 454. Deflector 454 is conventional insofar as it is an annular plate member having generally castellated outer circumferential side, indicated at 454*a*, and a central circular opening, indicated at 454*b*. The deflector plate 454 is mounted for movement with respect to the sprinkler body 440 and frame 450 by the provision of a pair of identical, diametrically positioned guide pins 496. The pins 496 are mounted for sliding vertical movement through the diametrically opposed arms 472, 473 of the tuning fork 470. Tuning fork 470 and pins 496 together comprise deflector support means for supporting the deflector 454 spaced away from the body 440 and generally aligned with outlet 442 when the sprinkler is activated. The tuning fork 470 has a central opening 470a and is preferably slipped over the inlet end of the sprinkler body 440. The central portion of the fork 470 rests upon a projecting portion of the outlet end of the body and is held in place by suitable means such as a circular, split ring clip, indicated generally at 474. Preferably too, means, indicated generally at 476, are provided for holding a deflector plate 454 without movement over or against the frame knuckle 452 or bottom sides of the fork arms 472, 473 to prevent possible damage to the deflector 454. The means 476 may be, for example, a retainer plug 477 received in a central bore in the lower portion of the knuckle 452 and held in place by friction or other suitable means such as a coil spring 478 having an outer diameter slightly greater than the inner diameter of the lower central bore of the knuckle 452**, so as to frictionally engage the bore.

Cover 10''', includes a ceiling member 14''' having concave and convex sides 15'', and 16''', respectively. A central circular planar portion, indicated generally at 17''', is surrounded by an annular conical portion, indicated generally at 18'''. The portions 17''' and 18''' are centered with respect to the common central axis 19. Bracket means, indicated generally at 20''', are provided projecting from the concave major side 15'' of the ceiling member 14'''. The bracket means 20''' are preferably provided by a pair of identical bracket members 22''' mounted diametrically with respect to the common central axis 19 and otherwise configured to receive the deflector 454 and the lower portion of the frame 450, including the knuckle 452, as well as the lower portion of the arms 472, 473 of the fork 470. Each bracket member 22''' preferably includes a base 24''' from which projects an arm 26''' supporting an inwardly deflected tab 27'''. A second tab 29''' is provided deflected outwardly from the arm 26''' generally parallel with but spaced from the base 24'''. Tab 29''' forms a stop preventing the cover 10''' from being pressed any closer to the sprinkler 412. Thermal release means, again preferably in the form of solder joints 64''' and 66''' are provided for releasing at least one and preferably both of the brackets 22''' from the ceiling member 14''' at a temperature above ambient room temperature and about 200° F. or less to permit the cover 10''' to fall away from the sprinkler 440 before or when the sprinkler activates. The tab 27''' of each bracket member 22''' is configured and positioned to engage with any of a plurality of discrete engagement structures, indicated generally at 464, which are provided along either arm 472, 473 of the tuning fork 470. The discrete engagement structures 364 may be ridges protruding from an outer surface of the arms 472, 473, grooves extending into such a surface or saw-tooth or sinusoidal-like structures having no portion parallel to the central axis 19. These structures 464 are provided to engage with the tabs 27''' of each of the bracket member 22'''. The complementary engagement structures 27''' and 464 permit the cover 10''' to be directly mounted to the tuning fork 470, vertically adjustable with respect to the tuning fork 470 and the remainder of the sprinkler 412 including outlet 442. Of course, a single, suitably configured engagement structure might be provided on the arms 472, 473, to engage any of a plurality of tabs provided on one or more arms of a suitably configured bracket member of an alternate embodiment cover (not depicted) for adjustable mounting of such a cover directly to the tuning fork in the manner, for example, of the mounting of the cover 10' of FIGS. 6—7.

Installation and operation of the sprinkler 412 and cover 10''' is straightforward. Sprinkler 412 is installed by the threading 446 to a conventional source of fire-retarding fluid such as a threaded drop nipple (not depicted). The cover 10''' is thereafter mounted by slipping the bracket members 22''' over the arms 472, 473 of the tuning fork 470 until tabs 29''' contact the ceiling C. In use, ceiling member 14''', which is preferably a heat-conducting metal plate, transfers heat to the solder joint(s) 64''' (and 66''') causing the joint(s) to melt, releasing the ceiling member 14'''. Heated gas flows through the ceiling opening between the arms of the tuning fork 470, heating the thermal-sensitive element 58 until that element melts or breaks, releasing the plug 460. Plug 460 is forced from the outlet 442 by the pressure of fire-retarding fluid in the sprinkler body. The beveled Teflon TM tube 463 assists by causing the plug 460 to tumble away from the frame 450 and the deflector plate 454. Fire-retarding fluid exiting the outlet 442 is deflected by the knuckle 452 and lower portion of the frame arms 448 onto the deflector plate 454, causing the deflector plate 454 to dislodge the retainer plug 477. This permits the deflector plate 454 to drop down and away from the sprinkler body 440 supported from the lower ends of the tuning fork arms 472, 473 by the upper ends of the guide pins 496. With this type of structure, a pendent sprinkler, including a frame monolithically formed with the sprinkler body, may be fully recessed into a ceiling and covered with a cover 10''', substantially flush with the lower surface of the ceiling. The tuning fork 470 is not subject to systemic loads to retain the plug 460 in the sprinkler body 440, and need only be sufficiently strong to support the deflector 454 once the sprinkler is activated. Accordingly, the tuning fork may be, for example, a stamping or otherwise bent metallic member of brass or other suitable, conventional, non-corroding material, or a stronger, harder-worked material, such as stainless steel.

Applicants hereby incorporate by reference the following other U.S. Patents disclosing various other related sprinkler constructions: U.S. Pat. No(s). 4,957,169, 4,014,388, 4,491,182 and 4,830,115.

While preferred embodiment covers 10' 10'', 10'' and 10''' have been disclosed for use with both frame and drop-style ceiling sprinklers, one of ordinary skill in the art will appreciate that a variety of modifications could be made to such covers and to the combination of such covers with such ceiling sprinklers, all of which are intended to be covered by the present invention.

For example, if desired, biasing means can be provided to tighten the engagement between the cover and deflector to prevent the deflector from moving or rattling on the deflector. For example, biasing means in the form of a spring can be provided. Preferably the spring is a resilient metal leaf spring which can be soldered or more permanently mounted to the ceiling member at the center 19 and includes a pair of arms extending generally transversely and outwardly from the center of the ceiling member to contact the bottom side of the deflector or frame and bias the tab(s) or other engagement means down onto an upper side of the deflector.

Also, instead of two identical bracket members, three or more identical or non-identical bracket members may be provided. Instead of cut and deflected tabs, other configurations such as ribs/grooves, dimples, etc., which also permit interference engagement with a circular deflector of a pendent-style sprinkler, may be provided. Although the tabs of some of the various disclosed bracket members provide up to four separate height adjustments, greater or lesser numbers of discrete engagement elements may be provided to provide a greater or lesser number of separate, mounting-height positions of the cover on the deflector. Although copper is a preferred material for both ceiling members and bracket members, either or both may be made of other material(s) and may even be of composite construction, for example, combining plastics and metals in different parts thereof. While face-to-face contact of planar portions of the ceiling member and bracket members is preferred for joining these members, any of a variety of other, known configurations and positions of such members or similar members may be used. While solder is preferred as thermal release means for joining the bracket members 22, 22', 22'' to the cover members 14, 14', 14'' any of a variety of materials which are solid at ambient room temperature and melt or soften below about 200° F. and preferably below 160° F., including certain waxes and plastics, can be used. However, the melting temperature of the solder or other bonding material should be distinctly below the temperature required to break or melt the trigger element employed. Furthermore, if desired, openings can be provided through the ceiling member 14, 14', 14'', 14''' to permit heated air to pass through the cover to begin heating of the temperature sensitive seal means as well.

In view of the numerous variations which are possible with respect to this invention, reference should be made to the appended claims, rather than to the foregoing embodiments, as indicating the scope of the invention.

I claim:

1. A cover adapted for use with a sprinkler including a sprinkler body having an outlet on one side thereof through which a fire-retarding fluid flows when the sprinkler activates, a deflector and deflector support means including a pair of arms extending away from the one side of the body for supporting the deflector spaced from the body generally aligned with the outlet to deflect fire-retarding fluid flowing from the outlet generally outwardly about the sprinkler body, the cover comprising:

a ceiling member having a pair of opposing major sides;

bracket means projecting from one major side of the ceiling member, the bracket means being configured to receive at least the deflector of the sprinkler; and a plurality of discrete engagement means positioned along the bracket means at a plurality of different heights from the ceiling member for engaging at least one of the deflector and the deflector support means at any of a plurality of different distances of the ceiling member from the outlet whereby the cover may be adjustably mounted to the sprinkler by direct coupling with the one of deflector and the deflector support means.

2. The cover of claim 1 wherein the bracket means includes at least three discrete engagement means spaced at different distances from the ceiling member.

3. The cover of claim 1 wherein each of the discrete engagement means is formed by a tab cut from a portion of the bracket means.

4. The cover of claim 1 wherein the bracket means comprises two bracket members spaced from one another around a center of the cover member.

5. The cover of claim 4 further comprising thermal release means for releasably joining at least one of the bracket members to the ceiling member, the thermal release means releasing the one bracket member from the ceiling member at a temperature above ambient room temperature and about 200° F. or less.

6. The cover of claim 5 wherein the thermal release means comprises a solder joint between the one bracket member and the ceiling member.

7. The cover of claim 6 in combination with the sprinkler wherein the arms of the sprinkler are immovably coupled with the sprinkler body.

8. The combination of claim 7 wherein the bracket means is configured to further receive at least a portion of the deflector support means proximal the deflector, wherein at least one of the plurality of discrete engagement means is positioned along the bracket means to contact at least part of the deflector support means and wherein the deflector support means includes complementary engagement means positioned for receiving at least the one of the plurality of discrete engagement means of the cover and supporting the cover directly from the deflector support means.

9. The combination of claim 7 wherein at least one of the discrete engagement means of the cover engages directly with the deflector.

10. The cover of claim in combination with the sprinkler, the arms of the sprinkler being immovably coupled with the sprinkler body.

11. The combination of claim 10 wherein the bracket means is configured to further receive at least a portion of the deflector support means proximal the deflector, wherein at least one of the plurality of discrete engagement means is positioned along the bracket means to contact at least part of the deflector support means and wherein the deflector support means includes complementary engagement means positioned for receiving at least the one of the plurality of discrete engagement means of the cover and supporting the cover directly from the deflector support means.

12. The combination of claim 1 wherein at least one of the discrete engagement means of the cover engages directly with the deflector.

13. The cover of claim 6 in combination with the sprinkler, the deflector being supported from the sprinkler body on an assembly including a plug valve received in the sprinkler body outlet before sprinkler activation, the plug valve being released from the sprinkler body outlet upon sprinkler activation and the deflector being supported by the pair of arms after sprinkler activation, the pair of arms being movably coupled to the sprinkler body to permit the deflector to move away from the sprinkler body upon sprinkler activation.

14. The cover of claim 1 in combination with the sprinkler, the deflector being supported from the sprinkler body on an assembly including a plug valve received in the sprinkler body outlet before sprinkler activation, the plug valve being released from the sprinkler body outlet upon sprinkler activation and the deflector being supported by the pair of arms after sprinkler activation, the pair of arms being movably coupled to the sprinkler body to permit the deflector to move away from the sprinkler body upon sprinkler activation.

15. A sprinkler adapted for directly receiving and supporting a ceiling cover including a ceiling member having a pair of opposing major sides, a bracket structure extending from one major side and a discrete engagement structure on the bracket structure, the sprinkler comprising:

a sprinkler body having an outlet on one side thereof through which a fire-retarding fluid flows when the sprinkler is activated;

deflector means for deflecting the fire-retarding fluid flowing from the outlet generally outwardly around the sprinkler body;

deflector support means including a pair of arms extending away from the one side of the sprinkler body towards the deflector means for supporting the deflector means on the one side spaced from the sprinkler body generally aligned with the outlet; and a plurality of discrete complementary engagement structures positioned along at least one of the arms, the engagement structures being positioned at different distances from the outlet for contacting and engaging the engagement structure on the ceiling cover bracket structure when the cover is fitted over the deflector and onto the arms of the sprinkler.

16. A cover adapted for use with a sprinkler including a sprinkler body having an outlet on one side thereof through which a fire-retarding fluid flows when the sprinkler activates, a deflector and deflector support means including a pair of arms extending away from the one side of the body for supporting the deflector-r spaced from the body generally aligned with the outlet to deflect fire-retarding fluid flowing from the outlet generally outwardly about the sprinkler body, the cover comprising:

a ceiling member having a pair of opposing major sides;

bracket means projecting from one major side of the ceiling member, the bracket means being configured for receiving at least the deflector of the sprinkler;

discrete engagement means on the bracket means for engaging at least one of the deflector and the deflector support means whereby the cover is mountable to the sprinkler by direct coupling with the one of deflector and the deflector support means; and thermal release means for releasably joining at least a portion of the bracket means to the ceiling member, the thermal release means releasing at least the portion of the bracket means from the ceiling member at a temperature above ambient room temperature and below about 200° F., thereby permitting the cover to fall away from the sprinkler.

17. The cover of claim 16 wherein the bracket means comprises two bracket members, at least one of the two bracket members being releasably attached to the ceiling member by the thermal release means.

18. The cover of claim 16 in combination with the sprinkler, the arms of the sprinkler being immovably coupled with the sprinkler body.

19. The combination of claim 18 wherein the bracket means is configured to further receive at least a portion of the deflector support means proximal the deflector, the discrete engagement means being positioned along the bracket means to contact at least part of the deflector support means and wherein the deflector support means includes complementary engagement means positioned for receiving the discrete engagement means of the cover and supporting the cover directly from the deflector support means.

20. The combination of claim 18 wherein the discrete engagement means of the cover engages directly with the deflector.

21. The sprinkler of claim 20 wherein the deflector is immovably supported by the arms from the sprinkler body.

22. The cover of claim 16 in combination with the sprinkler, the deflector being supported from the sprinkler body on an assembly including a plug valve received in the sprinkler body outlet before sprinkler activation, the plug valve being released from the sprinkler body outlet upon sprinkler activation and the deflector being supported by the pair of arms after sprinkler activation, the pair of arms being movably coupled with the sprinkler body to permit the deflector to move away from the sprinkler body upon sprinkler activation.

* * * * *